United States Patent [19]

Dore

[11] Patent Number: 4,770,195

[45] Date of Patent: Sep. 13, 1988

[54] FINGER MASSAGING DEVICE

[76] Inventor: Loretta M. Dore, 37 Thistle Rd., Norwalk, Conn. 06850

[21] Appl. No.: 754,335

[22] Filed: Jul. 12, 1985

Related U.S. Application Data

[63] Continuation-in-part of Ser. No. 513,380, Jul. 13, 1983, abandoned.

[51] Int. Cl.[4] ..... A45D 29/00

[52] U.S. Cl. ..... 132/73; 128/62 A

[58] Field of Search ..... 15/110; 132/74.5, 75.3, 132/75.6, 76.4, 76.5, 88.7, 79 A, 79 C, 82 A, 82 R, 83 B, DIG. 3, 73, 73.5, 73.6; 128/62 R, 62 A, 67

[56] References Cited

U.S. PATENT DOCUMENTS

| | | | |
|---|---|---|---|
| 899,626 | 9/1908 | Schultz | 132/73 X |
| 1,367,974 | 2/1921 | Ivory | 132/73 |
| 1,413,033 | 4/1922 | Keyser | 132/75.3 |
| 1,450,612 | 4/1923 | Schultz | 132/73.6 UX |
| 1,667,570 | 4/1928 | Thelander | 132/76.5 |
| 1,715,914 | 6/1929 | Halk | 132/73 |
| 1,796,893 | 3/1931 | McVeigh | 15/110 |
| 1,905,976 | 4/1933 | Wolf | 132/75.3 |
| 2,163,211 | 6/1939 | Wolf | 15/110 |
| 2,218,738 | 10/1940 | Boysen | 132/DIG. 3 |
| 2,236,096 | 3/1941 | Henry | 132/73.5 |
| 2,449,070 | 9/1948 | Hauser | 132/73 UX |
| 2,547,243 | 4/1951 | Amer | 128/67 |
| 2,615,453 | 10/1952 | Ohman | 132/73 |
| 3,050,072 | 8/1962 | Diener | 128/62 A |
| 4,205,664 | 6/1980 | Baccialon | 128/62 A |
| 4,559,957 | 12/1985 | Hokama | 132/73 |

OTHER PUBLICATIONS

Sagarin, Cosmetics, Science & Technology, 1957, p. 1016.

*Primary Examiner*—Richard J. Apley
*Assistant Examiner*—J. Welsh
*Attorney, Agent, or Firm*—Edward R. Hyde

[57] ABSTRACT

A device and method for massaging the end area of fingers to stimulate growth of the fingernails and enhance the appearance thereof. An elongated shaft member has an elastomer end adapted to be immersed in oil or cream for massaging the outer finger area.

2 Claims, 2 Drawing Sheets

FINGER MASSAGING DEVICE

BACKGROUND OF THE INVENTION

This application is a continuation in part of my application Ser. No. 513,380 filed July 13, 1983, now abandoned.

The present invention relates to a device and method for stimulating the growth of fingernails and the appearance and health of the cuticle area of a person's fingers.

In the normal course of day-to-day activities, a person's fingers tend to become roughened and the cuticles loose their shape, color and firmness. Because the upper areas of the finger ends, i.e. fingernail, cuticle and surrounding area, below the cuticle, are continuously in view, it is desirable that those areas be cosmetically attractive as well as firm and healthy.

Accordingly, it is an object of this invention to provide a device that is uniquely designed and adapted for use in massaging the fingernails and the area of a person's fingers somewhat below the cuticles to enhance the color, health, firmness and attractiveness thereof.

It is another object of the invention to provide a method for enhancing the color, health, firmness and attractiveness of the outer upper area of a person's fingers, as well as stimulating the growth of strong non-brittle fingernails.

A still further object of the invention is to provide a massaging device that serves to stimulate the blood circulation in the outer finger area to increase the health and attractiveness thereof.

Another object of the invention is to provide a cuticle area stimulator device that is of simple construction, safe to use and convenient to manually hold and manipulate.

These and other objects of the invention will become apparent from the following detailed description thereof considered with the following drawings.

DETAILED DESCRIPTION

Figure 1:
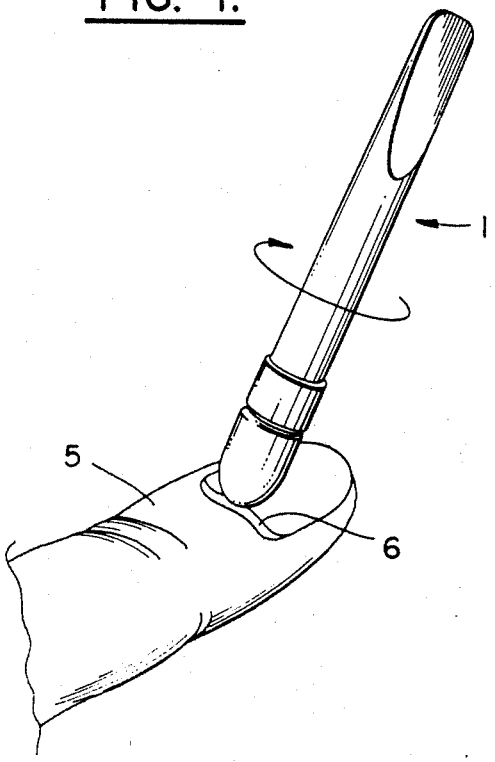
FIG. 1 is a perspective view of an embodiment of a massaging device of the present invention in position for massaging the outer upper area of a finger.
Figure 2:
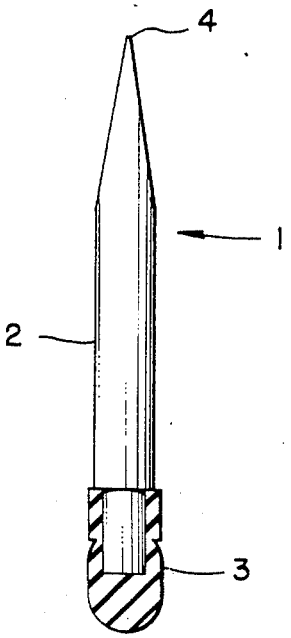
FIG. 2 is a side view partially in section of an embodiment of the massaging device of the present invention.

The massager-stimulator device of the present invention is shown as 1 in FIGS. 1 and 2 and comprises an elongated shank 2 which may be made of wood, plastic or other rigid material and may be cylindrical in cross section. The shank is approximately ⅜ inches in diameter, although its diameter dimension is not critical. It is only important that it is of a size that can be conveniently gripped by a person for proper manipulation of the fingernail area as hereinafter described. The terms fingernail area or cuticle area as used herein includes the fingernail, cuticle and the area approximately ¼ inch beyond the cuticle.

As shown in FIGS. 1 and 2 the upper portion of the shank is chisle-ended as at 4 and slightly rounded and smoothed. The other end of the shank is cut down to a smaller diameter as seen in FIG. 2 to receive a massage cap 3, bulbous in shape, which is the massaging end of the shank. The cap is somewhat compressible and rounded as shown in the drawings. Although it has compressibility, it must not be too soft. It has been found that the cap should be of a material having some degree of compressibility, softness, smoothness and rubbery in texture for massaging the fingernails and the cuticle area of the fingers. The cap 3 may be friction-fitted to the turned down area of the stem or it may be glued or cemented in place.

Figure 3:
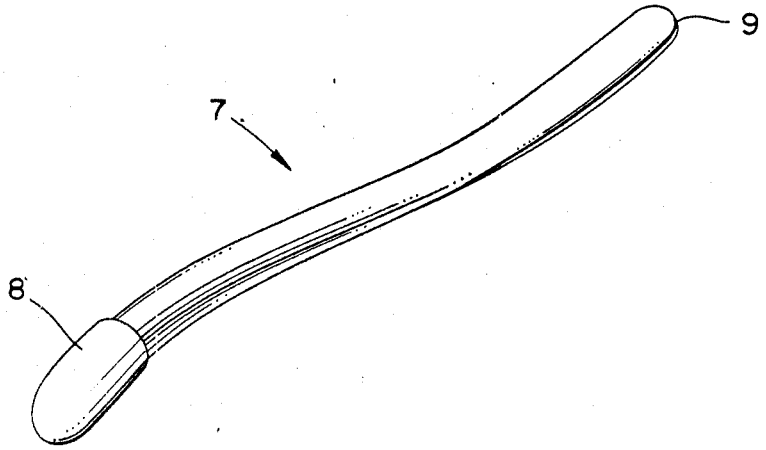
FIG. 3 is another embodiment of the massaging device of the present invention.

FIG. 3 illustrates another embodiment of the invention in which the stimulator 7 has a shank that is somewhat flattened in cross section and has a slightly double or S curve. It is the flattened sides that form the curve. It has been found that this contoured massager is especially convenient and comfortable to grasp and move in the circular massaging motion as described above.

In this embodiment the flattened end 9 is slightly rounded and serves to push back the cuticle in a manner similar to the end 4 of the embodiment of FIG. 2. The opposite end of the stimulator device 8 has a rubber cap of a material similar to the massage cap 3.

Figure 4:
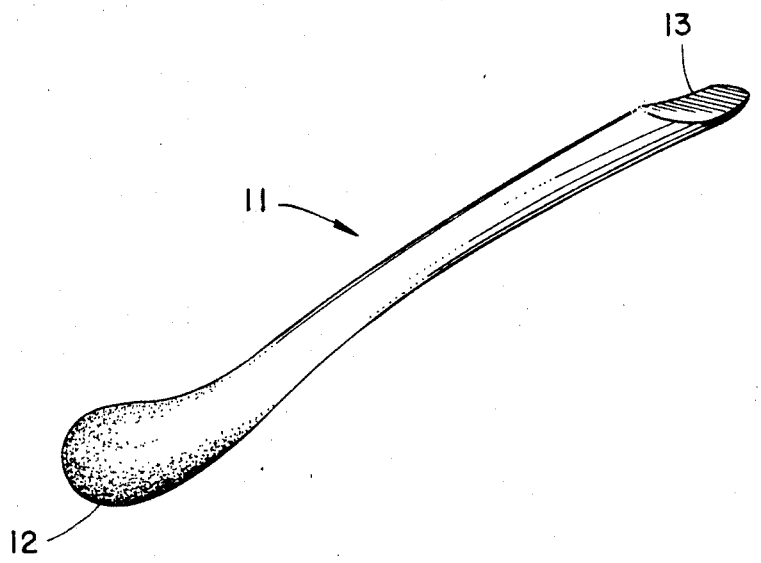
FIG. 4 is further preferred embodiment of the invention.

FIG.4 is another embodiment of the invention in which the device 11 is of a unitary structure and made of a plastic material.

The shank may be made of injection molded thermo plastic material and cylindrical in cross section. The shank is approximately ⅜ inches wide although its diameter dimension is not critical. It is only important that it is of a size that can be conveniently gripped by a person for proper manipulation of the fingernail area as hereinafter described.

The upper portion of the shank has a slightly concave shape and is smooth. The other end 12 is spherical in shape and serves as the massaging end of the device. The spherical end is compressible and rubbery in texture. It has been found that the spherical end should be of a material having the degree of compressibility, softness, smoothness, and oil and heat resistant such as an elastimer material. Thus it is rubbery and flexible in texture for massaging the fingernails and the cuticle area of the fingers.

The end 13 serves the same purpose of cuticle manipulation as in the prior embodiment, but is concave.

In operation fingernail cream or hot oil is applied to the fingernail cuticle area 6 of the finger 5 which is to be massaged. Any suitable fingernail or hand cream or natural oil may be used and it has been found that a number of creams sold commercially when used with the stimulator device of the present invention produces excellent results. The cream may be applied to the fingernail area in any convenient manner as by dipping the elastimer massage end 12 or cap into the cream or hot oil and then contacting the fingernail and the finger area approximately ¼ inch above the cuticle. The shank of the stimulator is then grasped in the fingers of the other hand and the massager-stimulator is moved in a circular motion as indicated in FIG. 1 so that the end of the spherical stimulator end makes circular contact with the creamed or oiled fingernail and cuticle area of the finger 5. It has been found that a suitable massaging period of approximately thirty seconds or fifty circular motions on each finger is adequate, and appropriately stimulates the blood circulation of the fingernail and cuticle area.

An alternative to the circular motion is an up and down motion. The area of ¼ inch beyond the cuticle is massaged by the circular or up and down motion. When this is done once per day for one to three weeks, it has been found that the cuticle areas develop a fine, healthy color and firmness and shape and fingernail growth is stimulated.

After the massaging is done as described above, the stimulator is turned around and the cuticle-pusher end is used to gently push the cuticle backward toward the back of the finger 5 and shape it into a graceful oval.

Although the invention has been described with respect to a specific embodiment thereof, it is understood that various embodiments can be made within the spirit and scope of the appended claims.

What is claimed is:

1. A device for massaging the area of fingers including the cuticle, fingernail and the area above the cuticle to enhance the attractiveness thereof and stimulate the growth of the fingernails comprising:

a rigid elongated unitary shank member of plastic material adapted to be held in a persons hand;

a massage means on one end of the shank member said means being of substantially spherical shape and of a compressible, elastic texture and smooth rounded surface adapted for massaging the finger area;

the other end of the shank member being rigid and substantially flattened thereby being adapted to push and form the finger cuticle; and said elongated shank being smoothly curved in two directions in a single plane and substantially flattened so that it may be conveniently grasped.

2. A method for massaging the fingernail area of fingers with a smooth, compressible massaging implement to stimulate the blood circulation within the finger and enhance the attractiveness thereof and stimulate the growth of the fingernails comprising the steps of:

applying a fingernail cream lubricant to the fingernail area of a finger including the cuticle and the area approximately ¼ inch up the finger beyond the cuticle; and massaging the entire said area for a period of approximately thirty seconds with a massaging implement having a smooth, compressible, rubbery texture in a circular motion.

* * * * *